United States Patent [19]

Reba

[11] 4,136,808

[45] Jan. 30, 1979

[54] WEB THREADING SYSTEM

[75] Inventor: Imants Reba, Vancouver, Wash.

[73] Assignee: Crown Zellerbach Corporation, San Francisco, Calif.

[21] Appl. No.: 853,692

[22] Filed: Nov. 21, 1977

[51] Int. Cl.[2] ..... B65H 17/32

[52] U.S. Cl. ..... 226/7; 226/91; 226/97; 226/197

[58] Field of Search ..... 226/7, 97, 91, 92, 197

[56] References Cited

U.S. PATENT DOCUMENTS

| | | | |
|---|---|---|---|
| 3,125,268 | 3/1964 | Bartholomay | 226/97 |
| 3,705,676 | 12/1972 | Overly | 226/97 |
| 4,043,495 | 8/1977 | Sander | 226/97 X |

*Primary Examiner*—Richard A. Schacher
*Attorney, Agent, or Firm*—Thomas R. Lampe

[57] ABSTRACT

A system for directing the tail of a web of flexible material to a predetermined location laterally offset from the normal path of movement of said web. The system includes a first Coanda nozzle directing a gaseous flow along a chute associated therewith and comprising a bottom wall and side walls, so that the gaseous flow induced by the Coanda nozzle entrains the web tail and causes it to move laterally in the web plane as it is directed to the predetermined location. A second Coanda nozzle is positioned downstream from the first Coanda nozzle and is angularly disposed relative thereto so that the web is again moved laterally about the web plane an additional incremental amount.

7 Claims, 4 Drawing Figures

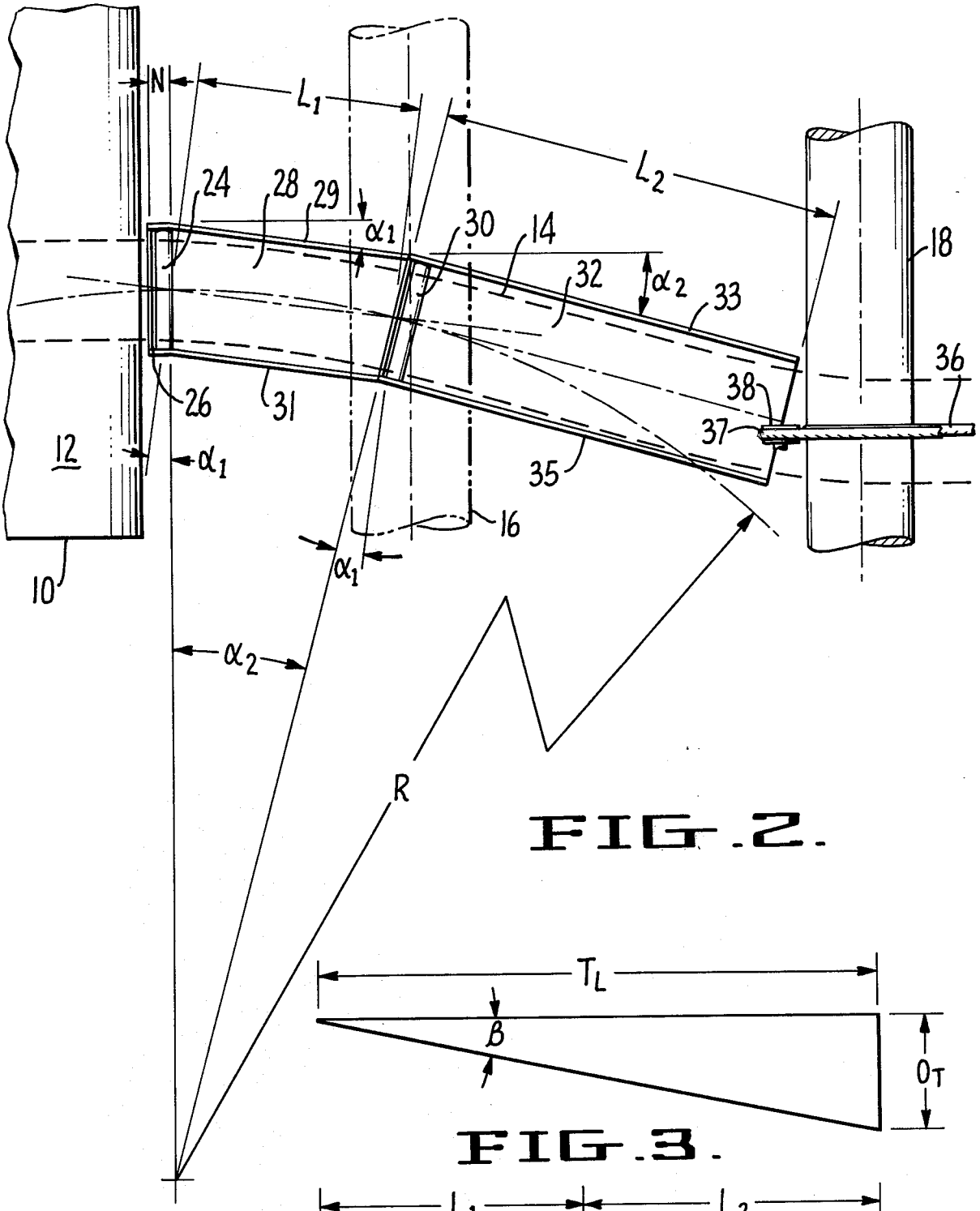
FIG. 2.
FIG. 3.
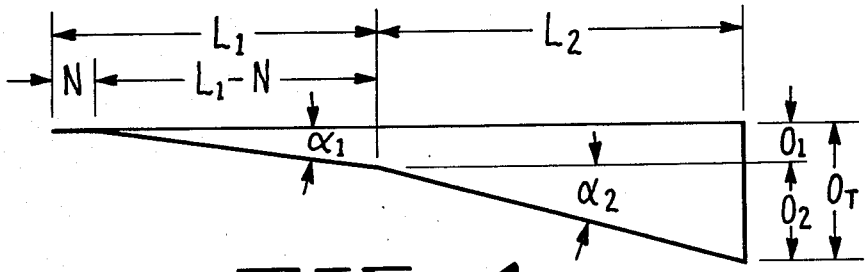
FIG. 4.

WEB THREADING SYSTEM

BACKGROUND OF THE INVENTION

U.S. Pat. Nos. 3,999,696 and 4,014,487 disclose systems for directing the end or tail of a moving web to a predetermined location such as into threading engagement with rolls forming a nip or the like. In the aforesaid systems, a gas such as air is directed through a restricted opening under pressure whereupon it attaches itself to a flow attachment surface due to the "Coanda effect", is directed to the predetermined location, and entrains ambient air. The tail of the web is placed into the path of the moving gas and entrained thereby. The gas is moving at a velocity greater than the velocity of the moving web and thus the web tail is straightened out and directed to the predetermined location.

In the arrangements illustrated in the aforesaid patents a web tail is received by the system and project directly forwardly to the desired location. There are, however, some manufacturing environments in which it is desirable to project a moving web, such as a paper web, to a location laterally offset from the direction in which the web is moving. One such situation occurs in paper machines wherein an offset rope nip may be employed to transport a web tail through a series of dryer cans or the like during the threading operation.

The present invention provides a system of relatively inexpensive and simple construction which utilizes the phenomenon known as the "Coanda effect" to entrain the free end or tail of a moving web of flexible material, change the direction of the web tail laterally in the web plane to a predetermined degree and direct it to a predetermined offset location such as a rope nip of the type commonly employed in paper machines and the like.

SUMMARY

The present invention includes a first bottom wall having a web entry end and web exit end and a first Coanda nozzle disposed at the web entry end to direct a gaseous flow therealong toward the exit end. The first Coanda nozzle is adapted to be positioned adjacent to a first mechanical means such as a rotating drum having a web contact surface for delivering a web of flexible material in a predetermined direction. The web is laterally displaced in the web plane a predetermined first angle of displacement as the web is propelled by the gaseous flow from the first Coanda nozzle along the first bottom wall. A second bottom wall having a web entry end and a web exit end is positioned downstream from the first bottom wall and has operatively associated therewith at its web entry end a second Coanda nozzle adapted to direct a gaseous flow toward the exit end of the second bottom wall. The second Coanda nozzle is angularly disposed relative to the first Coanda nozzle so that the web is again displaced laterally in the web plane a predetermined second angle of displacement before reaching the predetermined laterally offset location. The second angle of displacement is greater in magnitude than the first angle of displacement and preferably is at least twice as great.

BRIEF DESCRIPTION OF THE DRAWINGS

The preferred embodiment of the present invention is illustrated in the accompanying drawings in which:

FIG. 2 is a schematic plan view of the apparatus; and

FIGS. 3 and 4 are diagrammatic presentations illustrating geometric aspects of the invention utilized in the construction of the preferred embodiment.

GENERAL DESCRIPTION

Figure 1:
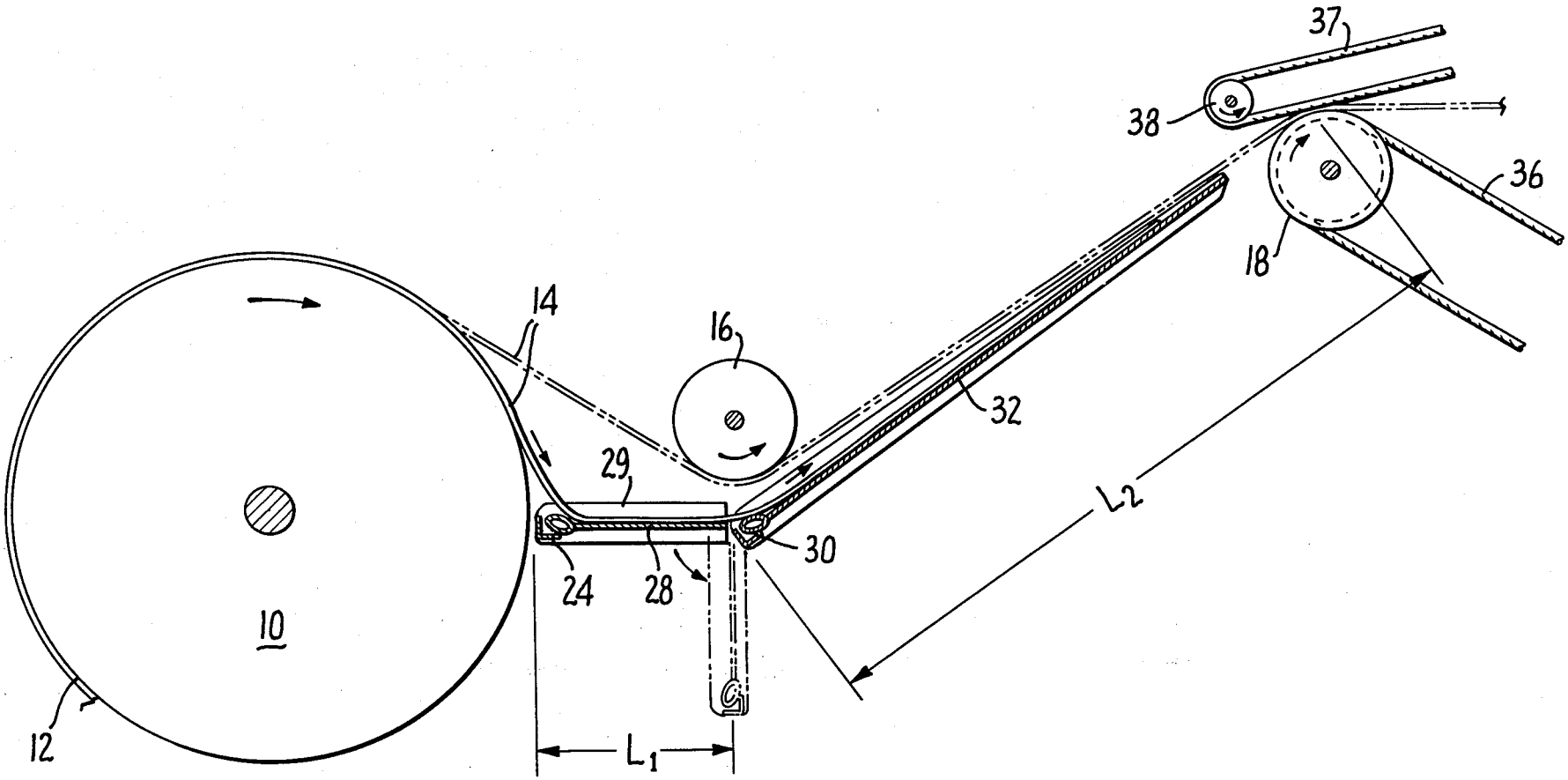
FIG. 1 is a schematic side view illustrating apparatus constructed according to the present invention.

Referring now to FIGS. 1 and 2, first mechanical means in the form of a dryer can 10 is illustrated. The dryer can has a web contact surface 12 for drying and delivering a paper web 14 in a well-known manner. During normal operation the web 14 passes directly from the web contact surface 12 and is delivered to the next stage of the manufacturing operation, the web moving forwardly of the dryer can after it leaves the web contact surface along a predetermined path of web movement. In the configuration illustrated in FIG. 1 paper web 14 passes about a roll 16 of conventional construction and over another roll 18 which may for example be the initial roll of a calendar, etc. It will be appreciated that the apparatus of the present invention may be employed in a wide variety of operational contexts other than that illustrated and that the configuration of FIGS. 1 and 2 is for illustrative purposes as it is quite typical of an operating environment where the present invention would be employed.

Positioned adjacent to the surface 12 below the normal exit location of web 14 is a first Coanda nozzle 24. This nozzle is of a two-dimensional type such as that illustrated in U.S. Pat. Nos. 3,999,696 and 4,014,487 and will not be described in detail other than to state that the nozzle includes a longitudinal exit slit 26 through which pressurized gas is emitted with the foil surface of the nozzle directing the emitted gas in a forward direction so that it, and any ambient gases entrained thereby, will flow along a first bottom wall 28 extending from the nozzle as shown in the aforesaid patents. Side walls 29 and 31 extend upwardly from the edges of wall 28 to form an open-topped trough or chute. In the event web 14 breaks, a tail will be formed by the operator as described in the afore-mentioned two patents and such tail will be entrained by the gases flowing along wall element 28 when placed into engagement therewith. The chute formed by walls 28, 29 and 31 is preferably pivoted at the web exit end thereof, i.e. the right end as viewed in FIG. 1, so that it may be swung from the illustrated phantom line position to the solid line position, thus bringing the web (which is moving downwardly from the dryer can) into engagement with the gaseous flow initiated by nozzle 24.

As the web tail moves along wall 28 the gaseous flow and the web are displaced laterally a predetermined angle $\alpha$ in the web plane by the wall 29 which is canted to this extent as may best be seen in FIG. 2. When the tail arrives at the end of wall 28 it is entrained by gaseous flow induced by a second Coanda nozzle 30 which has associated therewith a second bottom wall 32. Side walls 33 and 35 preferably extend upwardly from the edges of wall 32.

Disposed at the end of roller 18 is a rope 36 which forms a nip with a rope 37 entrained about a pulley 38, with the ropes forming a nip through which the web tail is to pass in the well-known manner. As may be seen with particular reference to FIG. 2, the rope nip is disposed at the extreme end of roll 18, that is, it is laterally offset from the normal path of movement of web 14. If the web were to be projected directly forwardly by the two Coanda nozzles the tail would miss the rope nip altogether and successful threading of the machine components with which the ropes are associated would not be successfully completed.

According to the present invention the second Coanda nozzle is angularly disposed relative to the first Coanda nozzle at an angle $\alpha_2$. The angular displacements $\alpha_1$ and $\alpha_2$ are calculated as follows. The first step is to determine the true length ($T_L$) of the path of the web (see FIGS. 1, 3 and 4):

$$T_L = L_1 + L_2 \quad (1)$$

where $L_1$ and $L_2$ are defined in FIG. 1.

The next step is to determine the offset distance $O_T$:

$O_T$ = distance from the edge of the web to the desired predetermined location, e.g. the center line of the rope nip plus one-half of the tail width. (2)

Next, the true length $T_L$ and the offset $O_T$ determines the overall tail sideways displacement angle $\beta$:

$$O_T/T_L = \tan \beta \quad (3)$$

Experiments have demonstrated that the tail sideways displacement is desirably made in two steps. It is first displaced by the angle $\alpha_1$, then by an angle $\alpha_2$.

The relationships between $\alpha_1$, $\alpha_2$ and $\beta$ are as follows:

$$\alpha_1 < \beta;\ \alpha_2 > \beta \text{ and } \alpha_1 = \tfrac{1}{2}\alpha_2 \quad (4)$$

EXAMPLE

Determination of $\alpha_1$ and $\alpha_2$ is an iterative process. To illustrate the design procedures a numerical example is now presented.

Given:

$L_1 = 21''$ $L_2 = 48''$ a. Therefore from eq. (1) $T_L = 69''$

Given:

Tail width — 8"

Distance from the edge of the web to the center line of rope nip — 7"

b. Therefore from eq. (2) $O_T = 11''$ c. From eq. (3):

$\tan \beta = 11/69 = 0.15942$ and $\beta = 9° 03'$ d. Now refer to FIG. 4 where N = the width of the pick-up nozzle = 2½", $O_1$ = lateral displacement by the second wall ele- 28, $O_2$ = lateral displacement by the second wall element 32 and $$O_T = O_1 + O_2 \quad (5)$$

then $L_1 - N = 21'' - 2\tfrac{1}{2}'' = 18\tfrac{1}{2}''$ $L_2 = 48''$ $$(L_1 - N) \tan \alpha_1 = O_1 \quad (6)$$

$$L_2 \tan \alpha_2 = O_2 \quad (7)$$

e. Since we know that $\alpha_1 < \beta;\ \alpha_2 > \beta$ and $\alpha_2 = 2\,\alpha_1$, assume $\alpha_1 = 5.5°$, $\alpha_2 = 11°$ Then from eqs. (6) and (7)

$O_1 = 18.5 \tan 5° 30' = 1.781''$ $O_2 = 48 \tan 11° = 9.330''$

From eq. (5):

$O_T = O_1 + O_2 = 11.101$, which is close enough to the required value of 11". Therefore the Coanda nozzle - wall element design will be based on $\alpha_1 = 5.5°$ and $\alpha_2 = 11°$.

FIG. 2 summarizes design features and indicates the radius of curvature R through which the tail bends in the horizontal plane.

$$R = \frac{1}{2}\ \frac{L_1 - N}{\sin \alpha_2} \quad (8)$$

The following table sets forth the dimensional characteristics of five paper machine threader installations that have been constructed according to the teachings of the present invention. It will be appreciated that dimensional requirements vary with each paper machine or other equipment wherein installations are made.

TABLE I

| Item | Degrees $\alpha_1$ | Degrees $\alpha_2$ | Inches $L_1$ | Inches $L_2$ | Inches R |
|---|---|---|---|---|---|
| 1 | 10 | 20 | 17⅞ | 32¼ | 21¾ |
| 2 | 2½ | 5 | 31 | 46½ | 163½ |
| 3 | 6 | 12 | 20 | 11½ | 42 |
| 4 | 3 | 6 | 17¼ | 48 | 70½ |
| 5 | 6 | 12 | 20 | 20½ | 42 |

I claim:

1. Apparatus for directing the tail of a web of flexible material to a predetermined location laterally offset from the initial path of movement of said web comprising:

a first bottom wall having a web entry end and a web exit end;

side walls extending upwardly from said first bottom wall;

a first Coanda nozzle having a longitudinal exit slit through which pressurized air is emitted disposed at the first bottom wall web entry end to direct a gaseous flow therealong toward said first bottom wall web exit end, one of said walls being positioned at a predetermined first angle of displacement relative to said first Coanda nozzle longitudinal exit slit whereby said gaseous flow and said web tail impinge against said one side wall and said web tail is displaced laterally in the web plane said predetermined first angle of displacement as said web tail is directed toward said predetermined laterally offset location; and a second bottom wall having a web entry end and a web exit end positioned downstream from said first bottom wall, said second bottom wall have operatively associated therewith at its web entry end a second Coanda nozzle adapted to direct a gaseous flow toward the exit end of said second bottom wall, said second Coanda nozzle being angularly disposed relative to said first Coanda nozzle whereby said web is again displaced laterally in the web plane a predetermined second angle of displacement.

2. The apparatus according to claim 1 wherein the second angle of displacement is greater in magnitude than said first angle of displacement

3. The apparatus according to claim 2 wherein the second angle of displacement is approximately twice as great as the first angle of displacement.

4. In combination:

first mechanical means having a web contact surface for delivering a web of flexible material in a predetermined direction;

second mechanical means having a web contact surface spaced from said first mechanical means and including nip defining means laterally offset from the web contact surface of said first mechanical means;

apparatus disposed between said first and second mechanical means for delivering a web tail therebetween for laterally displacing said web tail in the web plane as it is propelled forward to direct said web tail toward the nip defining means of said second mechanical means, said apparatus comprising:

a first bottom wall having a web entry end and a web exit end;

side walls extending upwardly from said first bottom wall;

a first Coanda nozzle having a longitudinal exit slit through which pressurized gas is emitted disposed at the first bottom wall web entry end substantially parallel to said mechanical means web contact surface to direct a gaseous flow along said first bottom wall toward said first bottom wall web exit end, one of said side walls being positioned at a predetermined first angle of displacement relative to said first Coanda nozzle longitudinal exit slit whereby said gaseous flow and said web tail impinge against said one side wall and said web tail displaced laterally in the web plane said predetermined first angle of displacement as said web tail is directed toward said predetermined laterally offset location; and a second bottom wall having a web entry end and a web exit end positioned downstream from said first bottom wall, said second bottom wall having operatively associated therewith at its web entry end a second Coanda nozzle adapted to direct a gaseous flow toward the exit end of said second bottom wall, said second Coanda nozzle being angularly disposed relative to said first Coanda nozzle whereby said web is again displaced laterally in the web plane a predetermined second angle of displacement.

5. The combination of claim 4 wherein said nip defining means comprises a movable flexible member and another movable element.

6. A method of directing the tail end of a web from a first location to a second location laterally offset from said first location comprising:

positioning a first Coanda nozzle having an elongated fluid flow exit slit between said first and second locations;

flowing a pressurized gas through the fluid flow exit slit of said first Coanda nozzle so that a gaseous flow is induced thereby along a bottom wall adjacent to said first Coanda nozzle;

operatively engaging said web tail and the gaseous flow induced by said first Coanda nozzle; and propelling said web tail with said gaseous flow so that said web tail engages a side wall projecting from said bottom wall and positioned at a first predetermined angle of displacement relative to said first Coanda nozzle elongated fluid flow exit slit, whereby said gaseous flow and said web tail impinge against said side wall and said web tail is laterally displaced in the web plane said first predetermined angle of displacement as it is propelled toward said second location by said gaseous flow;

positioning a second Coanda nozzle having an elongated fluid flow exit slit between said first Coanda nozzle and said second location with said second Coanda nozzle slit angularly displaced relative to said first Coanda nozzle slit;

flowing a pressurized gas through the fluid flow exit slit of said second Coanda nozzle so that a gaseous flow is induced thereby along a second planar wall adjacent to said second Coanda nozzle; and entraining said web tail in the gaseous flow of said second Coanda nozzle after the web tail has been propelled by the first Coanda nozzle to additionally laterally displace said web tail in the web plane as it progresses towards said second location.

7. The method according to claim 6 wherein the Coanda nozzles are positioned such that the second Coanda nozzle laterally displaces the web tail at a predetermined angle approximately twice the predetermined angle that the web is laterally displaced by gaseous flow induced by said first Coanda nozzle.

* * * * *